US009466875B2

(12) United States Patent
Wang

(10) Patent No.: US 9,466,875 B2
(45) Date of Patent: Oct. 11, 2016

(54) ANTENNA SYSTEM

(71) Applicant: Jianan Wang, Shenzhen (CN)

(72) Inventor: Jianan Wang, Shenzhen (CN)

(73) Assignee: AAC Acoustic Technologies (Suzhou) Co., Ltd., Suzhou (CN)

( * ) Notice: Subject to any disclaimer, the term of this patent is extended or adjusted under 35 U.S.C. 154(b) by 33 days.

(21) Appl. No.: 14/559,297

(22) Filed: Dec. 3, 2014

(65) Prior Publication Data

US 2015/0349404 A1 Dec. 3, 2015

(30) Foreign Application Priority Data

May 28, 2014 (CN) ..... 2014 2 0280453 U

(51) Int. Cl.

| | |
|---|---|
| ***H01Q 1/24*** | (2006.01) |
| ***H01Q 21/30*** | (2006.01) |
| ***H01Q 21/28*** | (2006.01) |
| ***H01Q 5/314*** | (2015.01) |
| ***H01Q 5/35*** | (2015.01) |

(52) U.S. Cl.

CPC ..... *H01Q 1/243* (2013.01); *H01Q 5/314* (2015.01); *H01Q 5/35* (2015.01); *H01Q 21/28* (2013.01); *H01Q 21/30* (2013.01)

(58) Field of Classification Search

CPC ..... H01Q 1/241–1/243; H01Q 5/30; H01Q 21/30

USPC ..... 343/702

See application file for complete search history.

(56) References Cited

U.S. PATENT DOCUMENTS

| | | | | |
|---|---|---|---|---|
| 2008/0062052 | A1* | 3/2008 | Suzuki | G01L 1/005 343/702 |
| 2014/0292584 | A1* | 10/2014 | Lin | H01Q 1/243 343/700 MS |
| 2015/0123871 | A1* | 5/2015 | Chang | H01Q 1/243 343/872 |

* cited by examiner

*Primary Examiner* — Hoang V Nguyen

(74) *Attorney, Agent, or Firm* — Na Xu; IPro, PLLC

(57) ABSTRACT

An antenna system is disclosed. The antenna system includes a printed circuit board, a metallic frame surrounding and electrically connecting with the printed circuit board, a low frequency antenna unit electrically connecting to the metallic frame and an antenna feed, a high frequency antenna unit electrically connecting to the metallic frame and the antenna feed, a ground terminal disposed on the metallic frame for grounding the metallic frame, and an adjusting terminal for being grounded via a matching component for adjusting the low frequency performance of the antenna system. The antenna system enables covering the operational frequency bands of 791 MHz~960 MHz, and 1710 MHz~2690 MHz. By virtue of the adjusting terminal, ultra wide low frequency of dual-resonance is accordingly performed.

6 Claims, 3 Drawing Sheets

ANTENNA SYSTEM

FIELD OF THE INVENTION

The invention relates to antennas, and more particularly to an antenna system cooperating with a metallic frame of an electronic device.

DESCRIPTION OF RELATED ART

Miniature and multi-band antennas are widely used in portable devices having the functions of telecom communications. Common wireless communicating standards include GSM850, GSM900, DCS, PCS and UMTS. The frequency bands thereof are generally 0.82 GHz-0.894 GHz, 0.88 GHz-0.96 GHz, and 1.71 GHz-2.17 GHz. Conventional mobile devices would not use conductive frame because the metallic frame would badly affect the radiation abilities of the antennas used therein. The reason is that the metallic frame would be a shell shielding the radiations from outside or inside of the mobile device. However, for enhancing the strength or making the devices more beautiful, metallic frames are more and more widely used. As mentioned above, the metallic frame will badly affect the performance of the antenna, such as narrowing the frequency band. The narrowing of the frequency band will not allow the devices to meet the frequency bands mentioned above. In order to solve this issue, slots or gaps are provided to divide the metallic frame into several parts, and the metallic frame cooperates with the antenna inside of the device to meet the frequency bands. Slots or gaps in the metallic frames make the mobile device ugly, and the users need to hold the mobile devices correctly for avoiding touching the slots or gaps, which is not convenient for the uses to use the mobile devices.

Accordingly, an improved antenna system which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
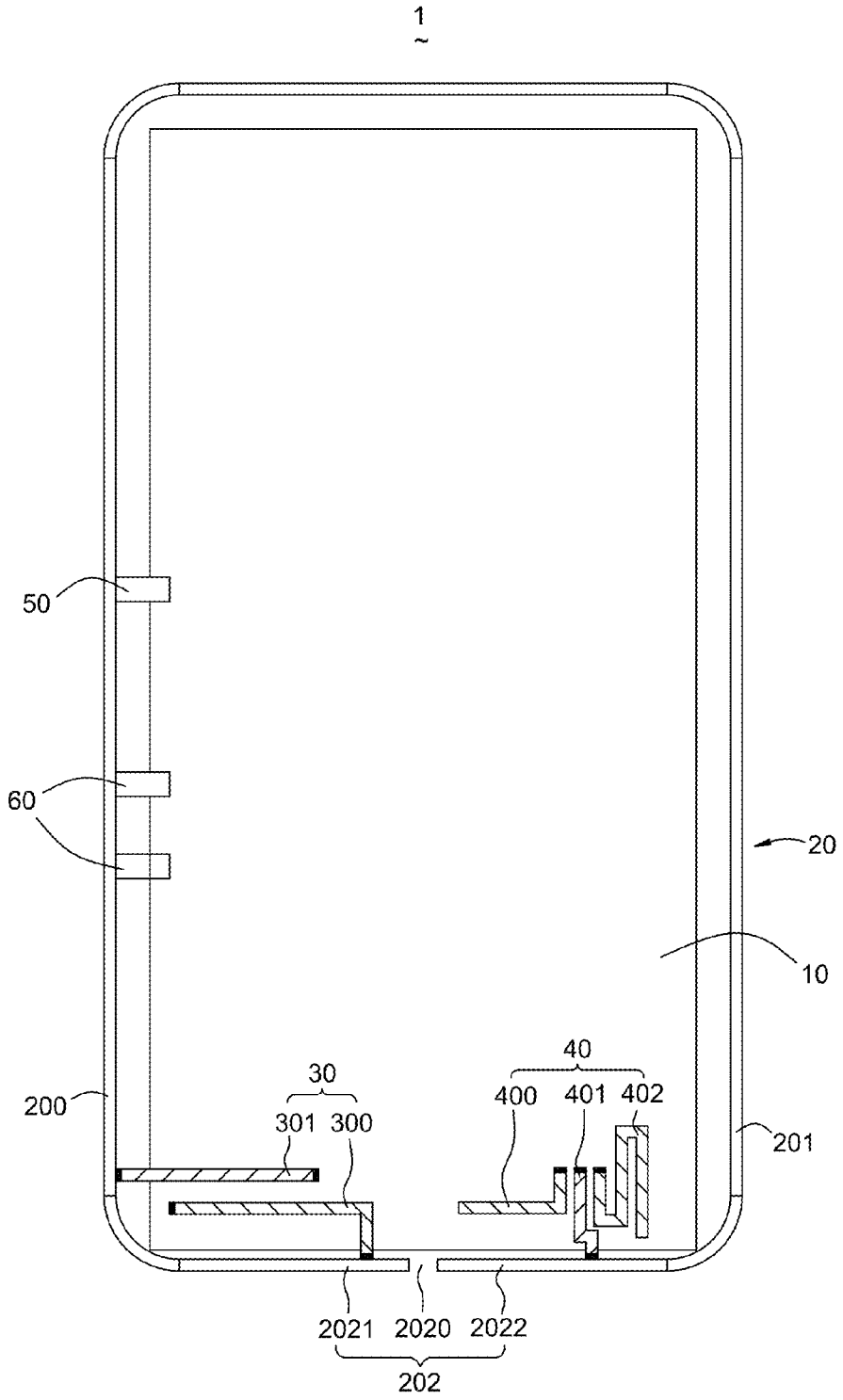
FIG. 1 is an illustrative configuration of an antenna system in accordance with an exemplary embodiment of the present disclosure.

Referring to FIG. 1 which shows an antenna system 1 in accordance with an exemplary embodiment of the present disclosure, the antenna system 1 includes a printed circuit board 10, a metallic frame 20 surrounding and electrically connecting with the printed circuit board 10, a low frequency antenna unit 30 electrically connecting to the metallic frame 20 and an antenna feed, a high frequency antenna unit 40 electrically connecting to the metallic frame 20 and the antenna feed, a ground terminal 50 disposed on the metallic frame 20 for grounding the metallic frame 20, and an adjusting terminal 60 for being grounded via a matching component for adjusting the low frequency performance of the antenna system 1. The matching component comprises a plurality of capacitors. By virtue of the adjusting component, ultra wide low frequency band of dual-resonance is performed, and almost of the communication frequency bands can be covered. The printed circuit board 10 may be a main board of an electronic device in which the antenna system 1 is applied.

The metallic frame 20 includes a first long radiation side 200, a second long radiation side 201 spaced from the first long radiation side 200, and a bottom side 202 connecting the first long radiation side 200 and the second long radiation side 201. The bottom side 202 forms a gap 2020 by which the bottom side 202 is divided into a first short radiation side 2021 connecting to the first long radiation side 200 and a second short radiation side 2022 connecting to the second long radiation side 201.

In the present embodiment, the gap 2020 is disposed at a middle portion of the bottom side 202. Alternatively, for a mobile device having an USB port, the gap 2020 may be arranged close to the USB port. The gap 2020 is used for adjusting a coupling coefficient between the first short radiation side 2021 and the second short radiation side 2022. A width of the gap 2020 should be determined by actual configuration. Wider the gap is, better radiation performance will be performed. The printed circuit board may be a main board of the mobile device.

The low frequency antenna unit 30 locates at one side of the gap 2020. The low frequency antenna unit 30 includes a first low frequency feed strip 300 that has one end electrically connecting to the first short radiation side 2021 and another end electrically connecting to the antenna feed and the printed circuit board 10. The low frequency antenna unit 30 further includes a second low frequency feed strip 301 that has one end electrically connecting to the first long radiation side 200 and another end connecting to the antenna feed and the printed circuit board 10. The low frequency antenna unit 30 is used for producing low frequency resonances within the range of 791~960 MHz. Radiation efficiencies of the low frequency antenna unit 30 at different frequencies are shown in Table 1 below.

TABLE 1

| Frequency | FS Efficiency | | BHR Efficiency | | BHL Efficiency | | BHHR Efficiency | |
|---|---|---|---|---|---|---|---|---|
| (MHz) | (%) | (dB) | (%) | (dB) | (%) | (dB) | (%) | (dB) |
| 790 | 22% | −6.67 | 12% | −9.18 | 13% | −8.79 | 11% | −9.52 |
| 810 | 21% | −6.78 | 12% | −9.33 | 10% | −9.92 | 10% | −10.07 |
| 830 | 19% | −7.31 | 8% | −11.24 | 8% | −11.03 | 6% | −11.88 |
| 850 | 26% | −5.80 | 10% | −10.08 | 11% | −9.69 | 7% | −11.34 |
| 870 | 37% | −4.28 | 13% | −8.97 | 16% | −7.96 | 9% | −10.67 |
| 890 | 37% | −4.30 | 15% | −8.17 | 20% | −6.97 | 9% | −10.63 |
| 910 | 35% | −4.53 | 17% | −7.74 | 23% | −6.42 | 9% | −10.34 |
| 930 | 28% | −5.52 | 15% | −8.10 | 21% | −6.77 | 9% | −10.64 |
| 950 | 22% | −6.50 | 13% | −8.80 | 17% | −7.70 | 7% | −11.25 |
| 960 | 19% | −7.11 | 11% | −9.41 | 14% | −8.43 | 7% | −11.83 |

Where:

FS means the value of the efficiencies when the mobile device is placed in a free space without being held.

BHFR means the value of the efficiencies when the mobile device is held by the right hand of a user.

BHL means the value of the efficiencies when the mobile device is held by the left hand of the user.

BHHR means the value of the efficiencies when the mobile device is held by the right hand and close to the head of the user.

The high frequency antenna unit 40 locates at another side of the gap 2020. The high frequency antenna unit 40 includes a first high frequency feed strip 400 that has one end electrically connecting to antenna feed, a second high frequency feed strip 401 that has one end electrically connecting to the second short radiation side 2022 and another end electrically connecting to the antenna feed, and a third high frequency strip 402 with one end thereof electrically connecting to the antenna feed. The high frequency antenna unit 40 is used for producing high frequency resonances within the range of 1710-2690 MHz. Radiation efficiencies of the high frequency antenna unit 40 at different frequencies are shown in Table 2 below.

TABLE 2

| Frequency | FS Efficiency | | BHR Efficiency | | BHL Efficiency | | BHHR Efficiency | |
|---|---|---|---|---|---|---|---|---|
| (MHz) | (%) | (dB) | (%) | (dB) | (%) | (dB) | (%) | (dB) |
| 1710 | 61% | −2.12 | 40% | −3.96 | 34% | −4.65 | 20% | −6.93 |
| 1770 | 55% | −2.56 | 40% | −4.02 | 36% | −4.47 | 21% | −6.71 |
| 1850 | 58% | −2.38 | 39% | −4.12 | 32% | −4.98 | 18% | −7.53 |
| 1910 | 55% | −2.60 | 39% | −4.12 | 31% | −5.15 | 16% | −8.03 |
| 1990 | 44% | −3.58 | 31% | −5.08 | 33% | −4.85 | 21% | −6.85 |
| 2070 | 42% | −3.79 | 33% | −4.87 | 25% | −6.03 | 25% | −6.06 |
| 2170 | 45% | −3.48 | 32% | −4.96 | 26% | −5.87 | 21% | −6.79 |
| 2310 | 56% | −2.53 | 39% | −4.12 | 30% | −5.27 | 19% | −7.11 |
| 2390 | 53% | −2.78 | 36% | −4.45 | 28% | −5.49 | 14% | −8.51 |
| 2470 | 61% | −2.15 | 40% | −3.99 | 31% | −5.05 | 13% | −8.85 |
| 2550 | 54% | −2.71 | 40% | −3.99 | 32% | −4.88 | 14% | −8.68 |
| 2630 | 43% | −3.67 | 41% | −3.92 | 35% | −4.59 | 15% | −8.33 |
| 2690 | 30% | −5.27 | 25% | −6.00 | 24% | −6.16 | 10% | −9.99 |

Where:

FS means the value of the efficiencies when the mobile device is placed in a free space without being held.

BHFR means the value of the efficiencies when the mobile device is held by the right hand of a user.

BHL means the value of the efficiencies when the mobile device is held by the left hand of the user.

BHHR means the value of the efficiencies when the mobile device is held by the right hand and close to the head of the user.

Figure 2:
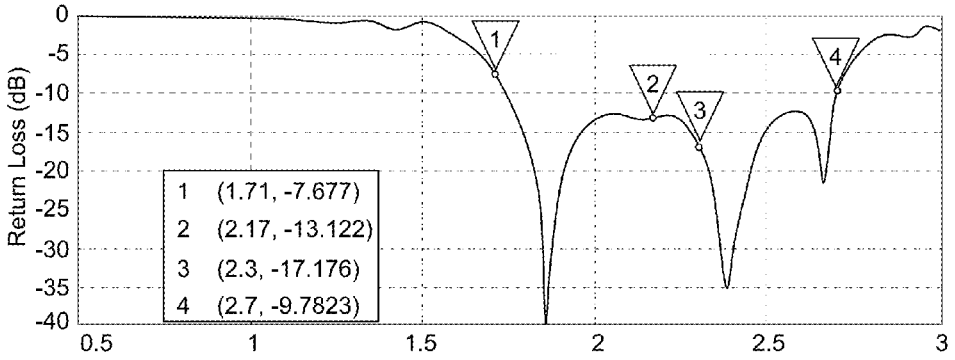
FIG. 2 is a diagram showing the return loss of the antenna system in FIG. 1, at high frequency band.
Figure 3:
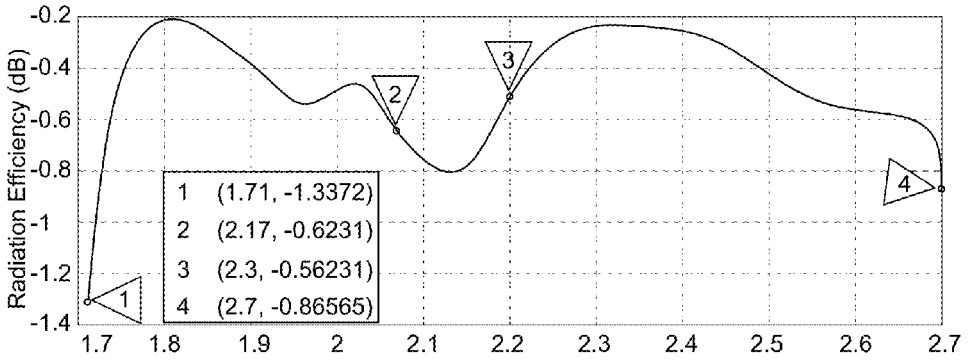
FIG. 3 is a diagram showing the radiation efficiency of the antenna system at high frequency band.
Figure 4:
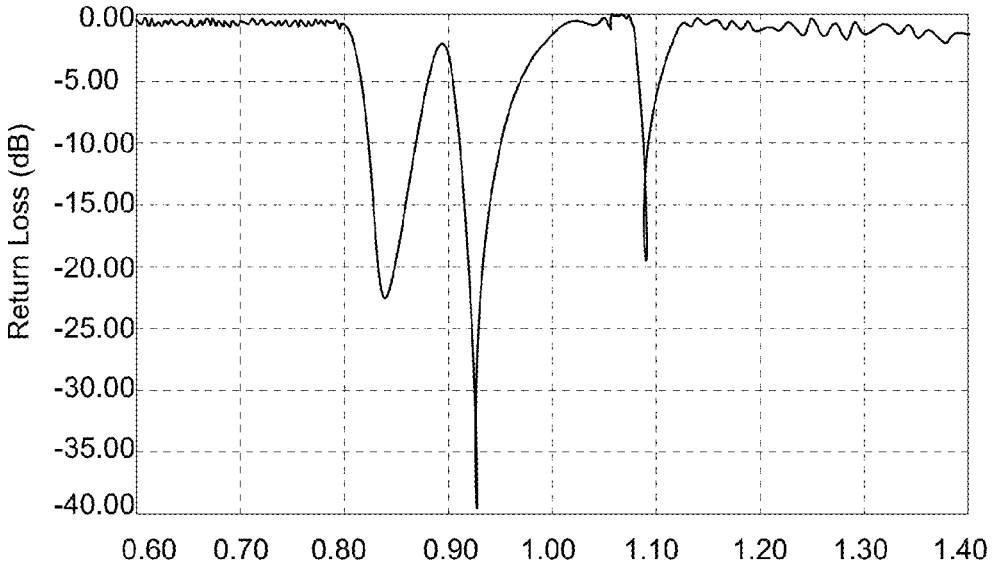
FIG. 4 is a diagram showing the return loss of the antenna system, at low frequency band.

Referring to FIGS. 2-3, which show the return loss and radiation efficiency at high frequency band of the antenna system 1, the performance of the antenna system 1 at high frequency band is excellent. Referring to FIG. 4 which shows the return loss of the antenna at low frequency band, the low frequency band is much wider.

As described above, the antenna system 1 of the present disclosure enables covering the operational frequency bands of 791 MHz~960 MHz, and 1710 MHz~2690 MHz, and satisfying the requirement of full-band. Only one gap is needed. By virtue of the adjusting terminal, ultra wide low frequency of dual-resonance is accordingly performed.

It is to be understood, however, that even though numerous characteristics and advantages of the present embodiment have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna system, comprising:

a printed circuit board;

a metallic frame surrounding and connecting to the printed circuit board, the metallic frame comprising, a first long radiation side, a second long radiation side spaced from the first long radiation side, a bottom side connecting the first long radiation side and the second long radiation side, the bottom side forming a gap for dividing the bottom side into a first short radiation side connecting to the first long radiation side and a second short radiation side connecting to the second long radiation side, a low frequency antenna unit at one side of the gap and electrically connecting to the metallic frame, the printed circuit board and an antenna feed;

a high frequency antenna unit at the other side of the gap and electrically connecting to the metallic frame, the printed circuit board and the antenna feed;

a ground terminal disposed on the metallic frame for grounding the metallic frame; and an adjusting terminal for being grounded via a matching component for adjusting the low frequency performance of the antenna system;

wherein the low frequency antenna unit includes a first low frequency feed strip that has one end electrically connecting to the first short radiation side and another end electrically connecting to the antenna feed and the printed circuit board, the low frequency antenna unit further includes a second low frequency feed strip that has one end electrically connecting to the first long radiation side and another end connecting to the antenna feed and the printed circuit board.

2. The antenna system as described in claim 1, wherein the high frequency antenna unit includes a first high frequency feed strip that has one end electrically connecting to antenna feed, a second high frequency feed strip that has one end electrically connecting to the second short radiation side and another end electrically connecting to the antenna feed, and a third high frequency strip with one end thereof electrically connecting to the antenna feed.

3. The antenna system as described in claim 2, wherein the high frequency antenna unit produces high frequency resonances within the range of 1710-2690 MHz.

4. The antenna system as described in claim 1, wherein the low frequency antenna unit produces low frequency resonances within the range of 791~960 MHz.

5. The antenna system as described in claim 1, wherein the gap is arranged at a middle portion of the bottom side.

6. The antenna system as described in claim 1, wherein the matching component comprises a plurality of capacitors.

* * * * *